US011702318B2

(12) United States Patent
Medeiros et al.

(10) Patent No.: US 11,702,318 B2
(45) Date of Patent: Jul. 18, 2023

(54) METHOD OF EXPANDING AN ELEVATOR SYSTEM IN A HOISTWAY

(71) Applicant: Otis Elevator Company, Farmington, CT (US)

(72) Inventors: Pedro Medeiros, São Bernardo do Campo (BR); Fausto Rodolfo Silva, São Bernardo do Campo (BR)

(73) Assignee: OTIS ELEVATOR COMPANY, Farmington, CT (US)

( * ) Notice: Subject to any disclaimer, the term of this patent is extended or adjusted under 35 U.S.C. 154(b) by 72 days.

(21) Appl. No.: 17/379,582

(22) Filed: Jul. 19, 2021

(65) Prior Publication Data

US 2023/0020453 A1 Jan. 19, 2023

(51) Int. Cl.
*B66B 11/00* (2006.01)
*B66B 7/02* (2006.01)
*B66B 19/00* (2006.01)

(52) U.S. Cl.
CPC ..... *B66B 11/0075* (2013.01); *B66B 7/023* (2013.01); *B66B 19/002* (2013.01); *B66B 7/021* (2013.01)

(58) Field of Classification Search
CPC ..... B66B 7/021; B66B 7/023; B66B 11/0075; B66B 19/002; B66B 19/02
See application file for complete search history.

(56) References Cited

U.S. PATENT DOCUMENTS 6,672,013 B1 1/2004 Glassey et al.
2011/0272223 A1 11/2011 Drayer et al.
2012/0291395 A1* 11/2012 Plathin ..... B66B 19/02 52/741.1
2013/0248299 A1 9/2013 Perälä et al.
2014/0367205 A1* 12/2014 Perala ..... B66B 11/008 187/251
2021/0245998 A1* 8/2021 Lanz ..... B66B 19/00
2022/0219945 A1* 7/2022 Lanz ..... B66B 19/00

FOREIGN PATENT DOCUMENTS

EP 2813460 A1 12/2014
JP 09025067 A * 1/1997 ..... B66B 19/002
WO WO-2005030630 A1 * 4/2005 ..... B66B 19/002
WO WO-2006010782 A2 * 2/2006 ..... B66B 19/002
WO WO-2015003965 A1 * 1/2015 ..... B66B 19/00

OTHER PUBLICATIONS

European Search Report; dated Dec. 9, 2022; Application No. 22185865.7; Filed: Jul. 19, 2022; 7 pages.

* cited by examiner

*Primary Examiner* — Minh Truong
(74) *Attorney, Agent, or Firm* — Cantor Colburn LLP

(57) ABSTRACT

Expanding an elevator system in a hoistway of a building including: parking an elevator car at or below a first level, between a first rail system extend along first wall of the hoistway and a second rail system extending along a second wall of the hoistway that is opposite the first wall; raising the second rail system to the second level; supporting an elevator machine with a bedplate; the elevator machine is operatively connected to a machine end of a tension system; and the tension system is operationally connected to the elevator car; engaging a first safety block, operatively connected to the bedplate, to release the second rail system; and raising the bedplate to the second level.

11 Claims, 12 Drawing Sheets

METHOD OF EXPANDING AN ELEVATOR SYSTEM IN A HOISTWAY

BACKGROUND

The embodiments relate to an elevator system and more specifically to a method of expanding an elevator system in a hoistway.

Modular building construction design restricts the use of a traditional outside material hoist. As floors are added, the elevator should be relatively quickly able to service the new landings without disrupting the construction of the modular building.

BRIEF SUMMARY

Disclosed is a method of expanding an elevator system in a hoistway of a building including: parking an elevator car at or below a first level, between a first rail system extend along first wall of the hoistway and a second rail system extending along a second wall of the hoistway that is opposite the first wall, wherein the first rail system extends to a first top end located at second level that is above the first level, and the second rail system extends to a second top end that is below the second level; raising the second rail system to the second level; supporting an elevator machine with a bedplate; the elevator machine is operatively connected to a machine end of a tension system; and the tension system is operationally connected to the elevator car; engaging a first safety block, operatively connected to the bedplate, to release the second rail system, whereby the bedplate is configured to move against the second rail system; and raising the bedplate to the second level.

In addition to one or more aspects of the method, the method further includes raising the bedplate to the second level via a winch, securing the bedplate to the second level, and disconnecting the winch, wherein prior to raising the second rail system to the second level, the method includes: disconnecting a spool, operatively connected a spool end of the tension system, from the first wall, and connecting the spool to a ceiling of the elevator car, wherein raising the bedplate to the second level draws an additional length of the tension system from the spool; and after releasing the bedplate from the winch, the method includes: raising the elevator car to the second level and parking the elevator car at the second level; disconnecting the spool from the elevator car, and reconnecting the spool to the first wall.

In addition to one or more aspects of the method, securing the bedplate to the second level includes: engaging the first safety block to fix the bedplate against the second rail system.

In addition to one or more aspects of the method, raising the second rail system to the second level includes: connecting a bottom end of a first rail extension member to a top end of a first rail of the second rail system.

In addition to one or more aspects of the method, the bottom end of the first rail extension member is connected to the top end of the first rail of the second rail system via a first rail bracket.

In addition to one or more aspects of the method, after raising the bedplate to the second level, the method includes trimming a top portion of the first rail extension member so that it is level with a top of the bedplate; and attaching a rail cover to the bedplate, to thereby cover the top end of the first rail.

In addition to one or more aspects of the method, utilizing a leveling feature to level the bedplate against the top end of the first rail.

In addition to one or more aspects of the method, after attaching the rail cover to the bedplate, the method includes: engaging a first fixation clip, operatively connected to the bedplate, against the second rail system; and removing the first safety block from the bedplate.

In addition to one or more aspects of the method, the second rail system includes a plurality of rails, including the first rail, the plurality of rails are respectively extended via a plurality of rail extension members, including the first rail extension member, that are respectively connected to one another via a plurality of rail brackets, including the first rail bracket; and the bedplate defines a plurality of pass-through apertures for respectively receiving the plurality of rails.

In addition to one or more aspects of the method, each of the plurality of pass-through apertures, at a top surface of the bedplate, defines a top boundary edge that is chamfered to guide respective ones the plurality of rail brackets into the plurality of pass-through apertures.

Disclosed is an elevator system in a hoistway of a building, formed by a process including: parking an elevator car at or below a first level, between a first rail system extend along first wall of the hoistway and a second rail system extending along a second wall of the hoistway that is opposite the first wall, wherein the first rail system extends to a first top end located at second level that is above the first level, and the second rail system extends to a second top end that is below the second level; raising the second rail system to the second level; supporting an elevator machine with a bedplate; the elevator machine is operatively connected to a machine end of a tension system; and the tension system is operationally connected to the elevator car; engaging a first safety block, operatively connected to the bedplate, to release the second rail system, whereby the bedplate is configured to move against the second rail system; and raising the bedplate to the second level.

In addition to one or more aspects of the process of forming the system, the process further includes raising the bedplate to the second level via a winch, securing the bedplate to the second level, and disconnecting the winch, wherein prior to raising the second rail system to the second level, the method includes disconnecting a spool, operatively connected a spool end of the tension system, from the first wall, and connecting the spool to a ceiling of the elevator car, wherein raising the bedplate to the second level draws an additional length of the tension system from the spool; and after releasing the bedplate from the winch, the method includes: raising the elevator car to the second level and parking the elevator car at the second level; disconnecting the spool from the elevator car, and reconnecting the spool to the first wall.

In addition to one or more aspects of the process of forming the system, securing the bedplate to the second level includes: engaging the first safety block to fix the bedplate against the second rail system.

In addition to one or more aspects of the process of forming the system, raising the second rail system to the second level includes: connecting a bottom end of a first rail extension member to a top end of a first rail of the second rail system.

In addition to one or more aspects of the process of forming the system, the bottom end of the first rail extension member is connected to the top end of the first rail of the second rail system via a first rail bracket.

In addition to one or more aspects of the process of forming the system, after raising the bedplate to the second level, the method includes: trimming a top portion of the first rail extension member so that it is level with a top of the bedplate; and attaching a rail cover to the bedplate, to thereby cover the top end of the first rail.

In addition to one or more aspects of the process of forming the system, the process includes utilizing a leveling feature to level the bedplate against the top end of the first rail.

In addition to one or more aspects of the process of forming the system, after attaching the rail cover to the bedplate, the method includes: engaging a first fixation clip, operatively connected to the bedplate, against the second rail system; and removing the first safety block from the bedplate.

In addition to one or more aspects of the process of forming the system, the second rail system includes a plurality of rails, including the first rail, the plurality of rails are respectively extended via a plurality of rail extension members, including the first rail extension member, that are respectively connected to one another via a plurality of rail brackets, including the first rail bracket; and the bedplate defines a plurality of pass-through apertures for respectively receiving the plurality of rails.

In addition to one or more aspects of the process of forming the system, each of the plurality of pass-through apertures, at a top surface of the bedplate, defines a top boundary edge that is chamfered to guide respective ones the plurality of rail brackets into the plurality of pass-through apertures.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
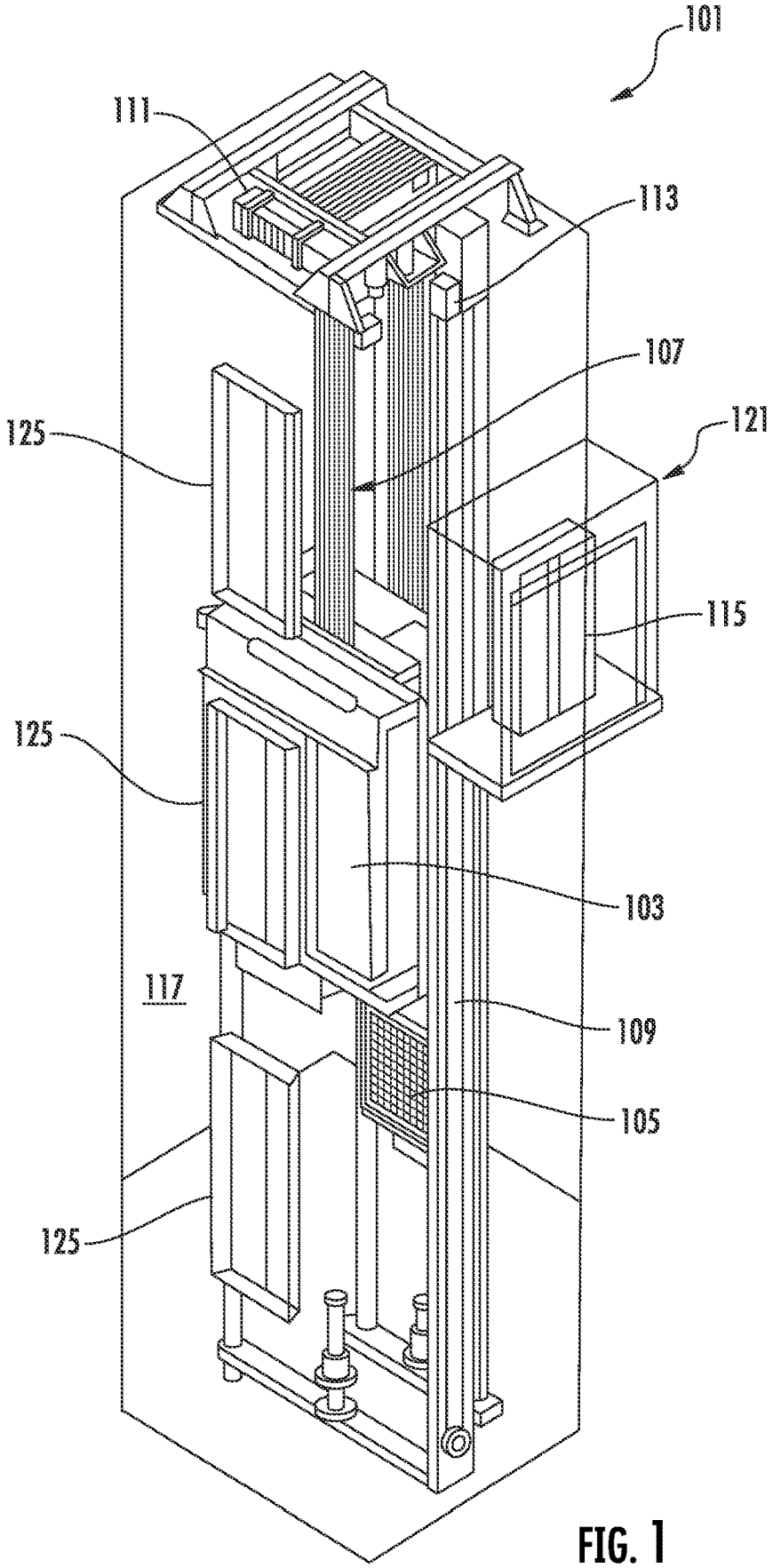
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. Embodiments may also be employed in ropeless elevator systems using self-propelled elevator cars (e.g., elevator cars equipped with friction wheels, pinch wheels or traction wheels). FIG. 1 is merely a non-limiting example presented for illustrative and explanatory purposes.

Figure 20:
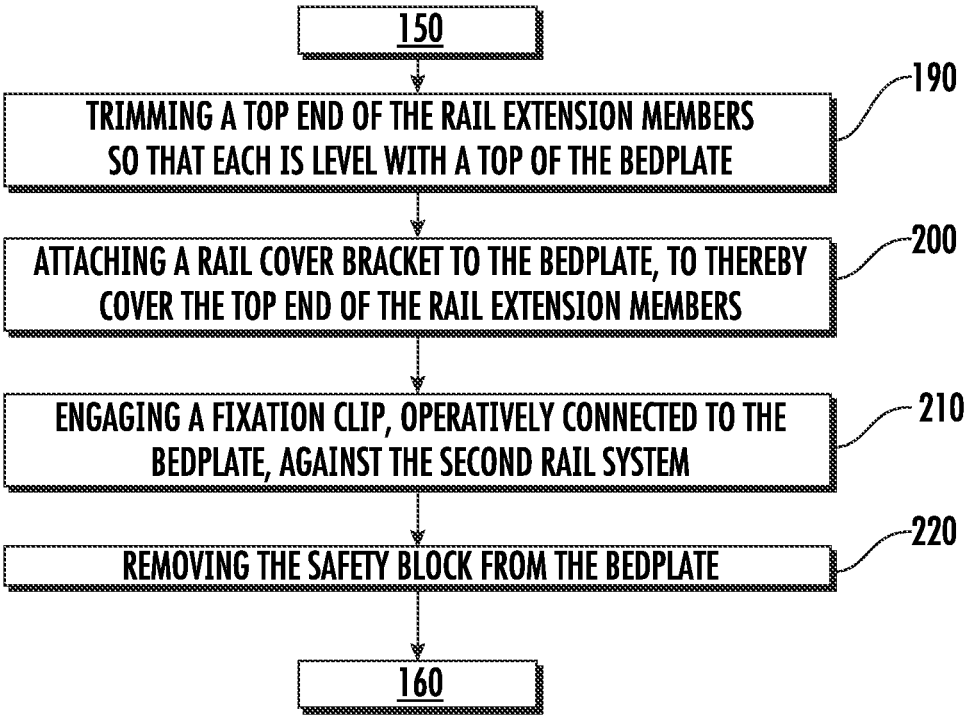
FIG. 20 is a flowchart showing additional aspects of the method shown in FIG. 19, when the expansion terminates at a highest level in a building.
Figure 21:
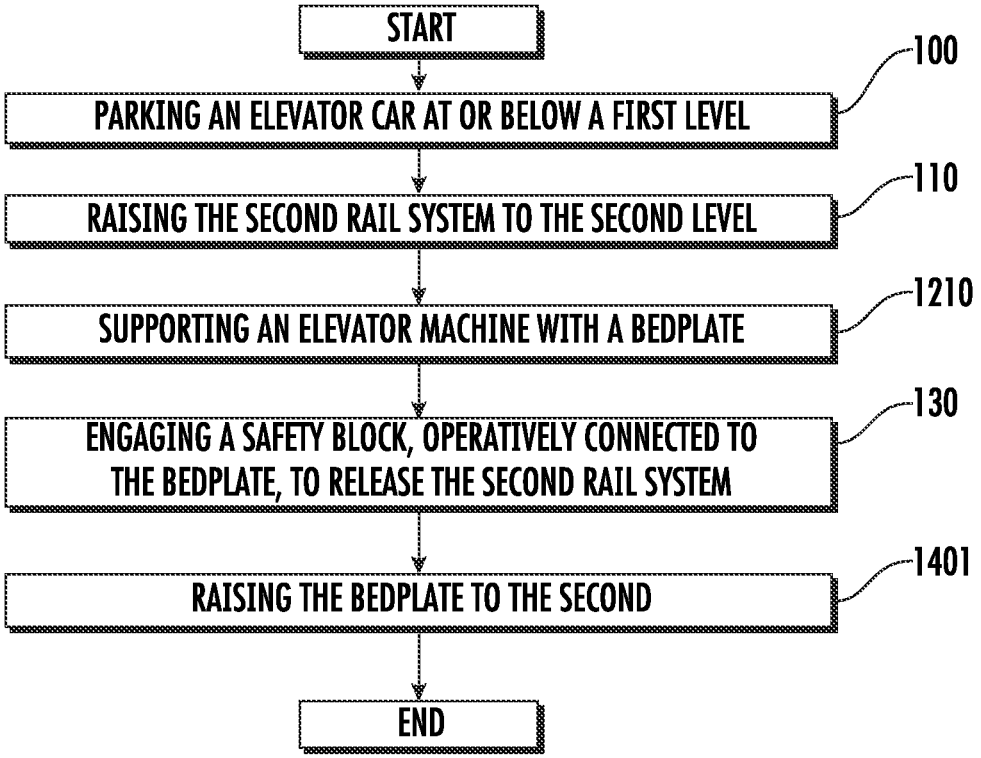
FIG. 21 is another flowchart showing a method of expanding an elevator system.

As indicated, in modular building construction design as floors are added, the elevator should be relatively quickly able to service the new landings without disrupting the construction of the modular building. In view of this objective, the disclosed embodiments provide an installation method for expanding a rise of an elevator system 101 in a hoistway 117, which may be referred to as a jump process. FIGS. 2-18 show an elevator system 101 in a hoistway 117 during various stages of expansion between levels 125A, 125B, while FIGS. 19-21 are flowcharts showing a method of expanding the elevator system 101 between the levels 125A, 125B.

Figure 2:
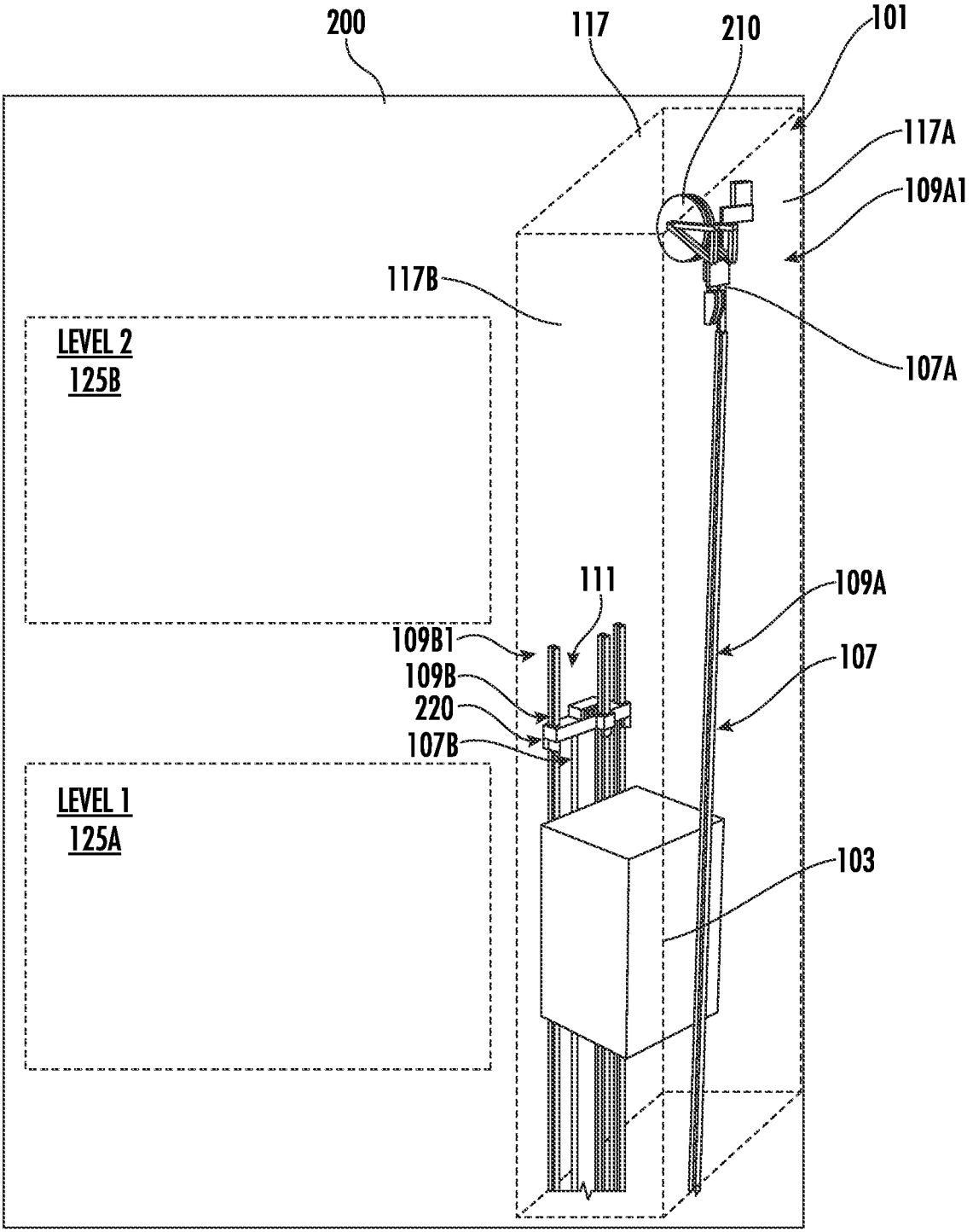
FIG. 2 shows components of an elevator system that is prepared for expansion to a second hoistway level according to an embodiment.

With reference to FIG. 2, the elevator system 101 includes an elevator car 103 parked at or below a first level 125A of the building 200. As shown in FIG. 2, the elevator car 103 is parked at the first level 125A. In the hoistway 117, the elevator car 103 is supported between a first rail system 109A that extends along first wall 117A of the hoistway 117, and a second rail system 109B that extends along a second wall 117B of the hoistway 117 that is opposite the first wall 117A. At the stage of expansion in FIG. 2, the first rail system 109A extends to a second level 125B that is above the first level 125A, and the second rail system 109B terminates below the second level 125B, e.g., at or slightly above the first level 125A. A spool 210 of the tension system 107 is connected to the first wall 117A, near a first top end 109A1 of the first rail system 109A, and is operatively connected to a spool end 107A of a tension system 107. The tension system 107 is operationally connected to the elevator car 103. A bedplate 220 is secured to and supported by the second rail system 109B, near a second top end 109B1 of the second rail system 109B. The bedplate 220 supports an elevator machine 111. The elevator machine 111 is operatively connected to a machine end 107B of the tension system 107.

Figure 19:
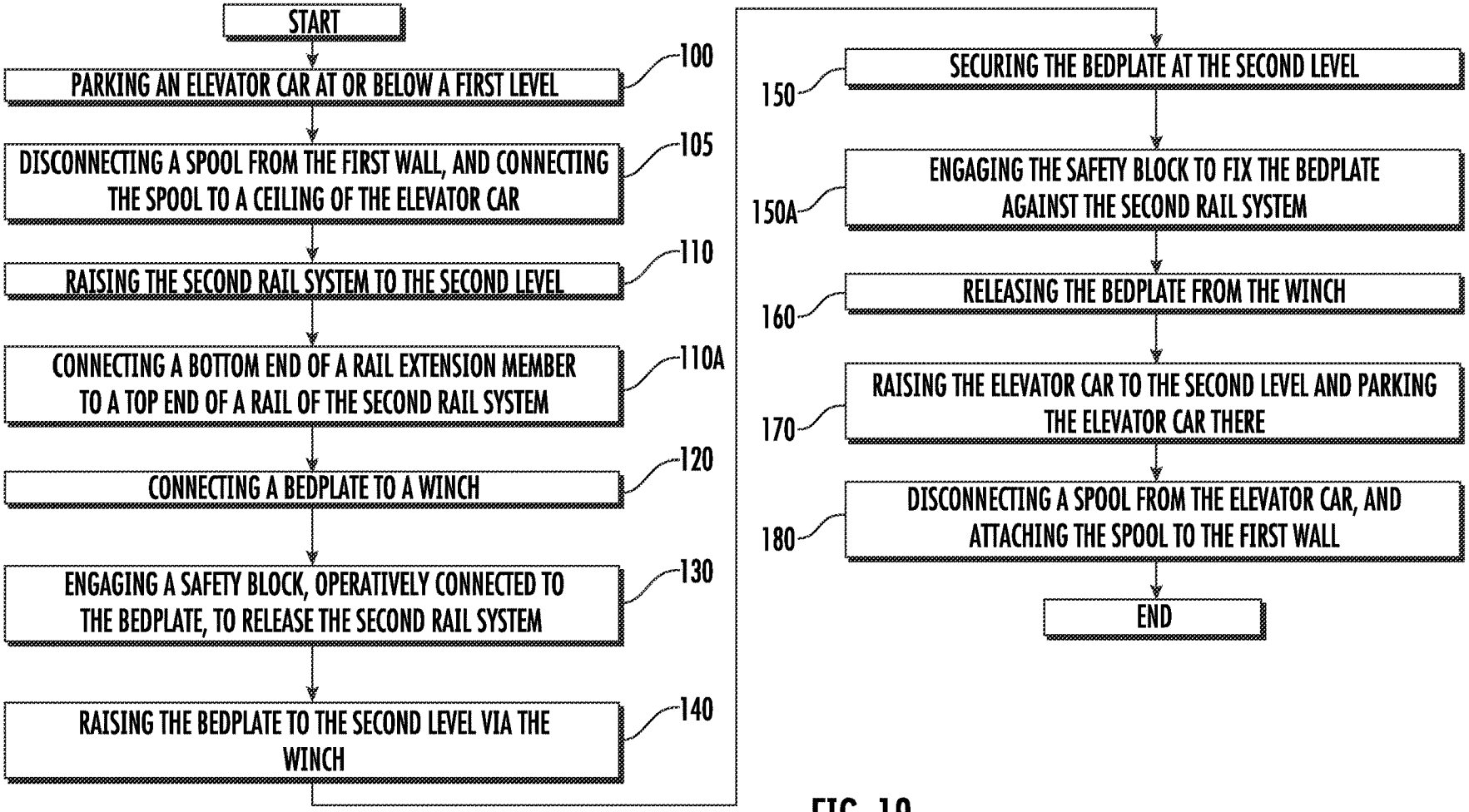
FIG. 19 is a flowchart showing a method of expanding an elevator system.

With reference to FIGS. 2 and 19, the method of expanding the elevator system 100 includes block 100 of parking the elevator car 103 at or below the first level 125A of the building 200, as indicated. With reference to FIGS. 3-5 and 19, at block 105, the method includes disconnecting the spool 210, operatively connected to the spool end 107A of the tension system 107, from the first wall 117A, and connecting the spool 210 to a ceiling 103A of the elevator car 103. This results in enough slack in the tension system to enable raising of the bedplate 220 (discussed below).

Figure 5:
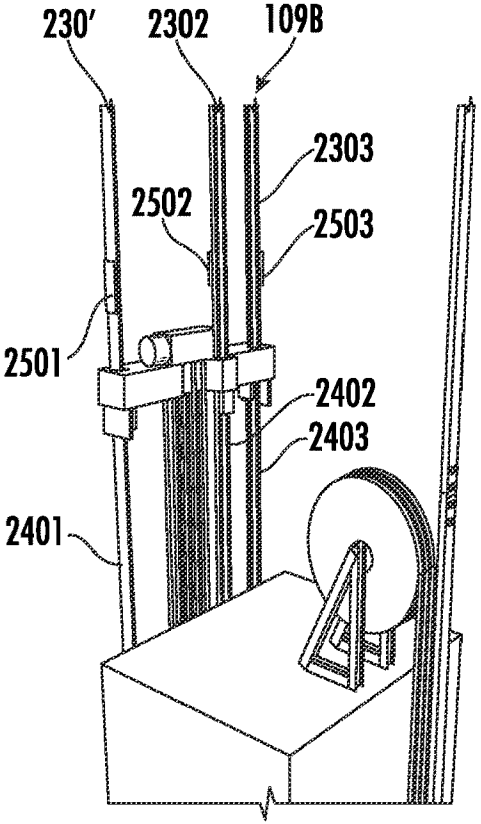
FIG. 5 shows a stage of expansion of the elevator system, where several rails are extended.
Figure 4:
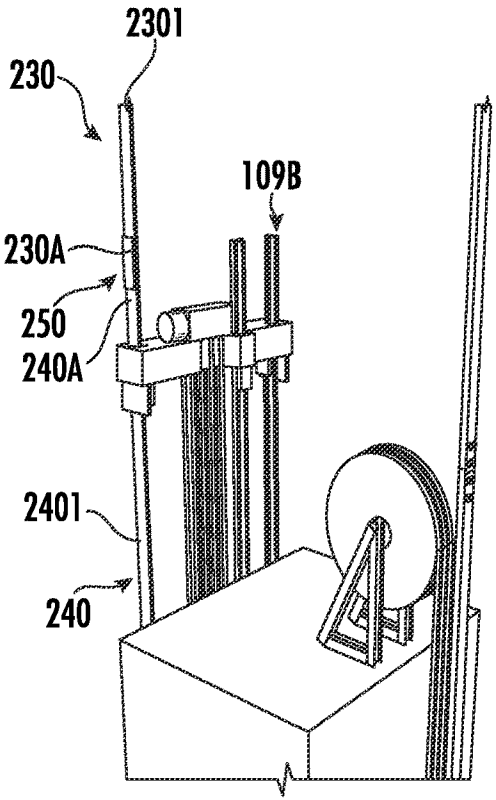
FIG. 4 shows a stage of expansion of the elevator system, where a rail is extended.
Figure 3:
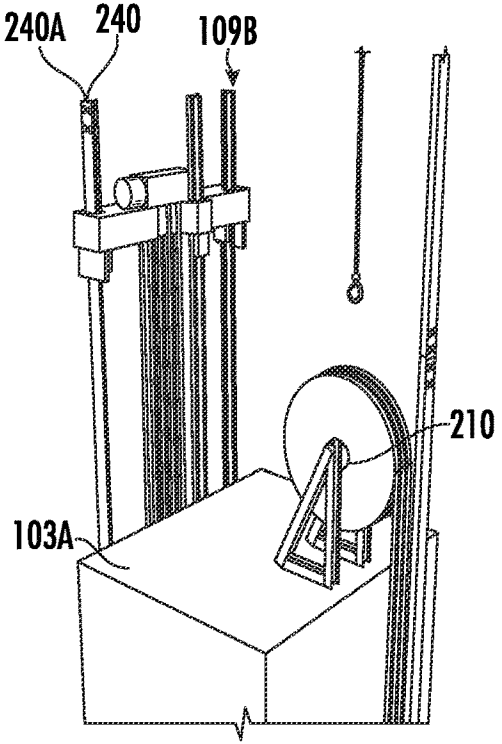
FIG. 3 shows a stage of expansion of the elevator system, where a spool is connected to a ceiling of an elevator car.

With reference to FIGS. 4-5 and 19, as shown in block 110, the method includes raising the second rail system 109B to the second level 125B. As shown in block 110A, raising the second rail system 109B to the second level 125B is accomplished by connecting a bottom end 230A of a first rail extension member 2301 (generally identified as 230) to a top end 240A of a first rail 2401 (generally identified as 240) of the second rail system 109B. The bottom end 230A of the first rail extension member 2301 may be connected to the top end 240A of the first rail 2401 of the second rail system 109B via a first rail bracket 2501 (generally identified as 250), otherwise known as a fishplate. In one embodiment, the second rail system 109B includes a plurality of rails 2401, 2402, 2403, e.g., first, second and third rails. The plurality of rails 2401, 2402, 2403 are respectively extended via a plurality of rail extension members 2301, 2302, 2303, e.g., first, second and third rail extension members, that are respectively connected to one another. This connection is accomplished via a plurality of rail brackets 2501, 2502, 2503, e.g., first, second and third rail brackets. Once the second rail system 109B is raised, the height of the second top end 109B1 of the second rail system 109B is substantially level with, or near, the first top end 109A1 of the first rail system 109A.

Figure 6:
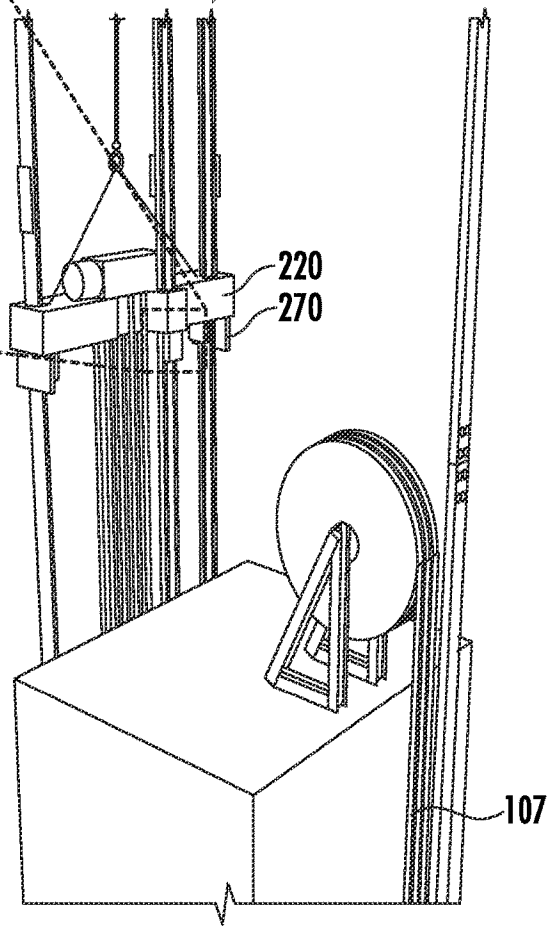
FIG. 6 shows a stage of expansion of the elevator system, where a bedplate is connected to a winch.
Figure 6A:
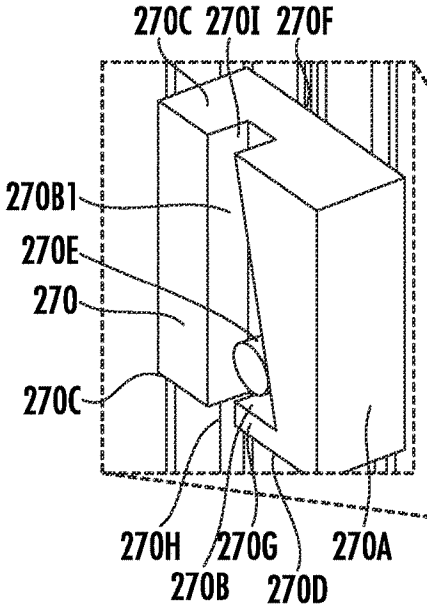
FIG. 6A shows features of a safety block.

With reference to FIGS. 6 and 19, as shown in block 120, the method includes connecting the bedplate 220 to a winch 260. As shown in block 130, the method includes engaging a first safety block 2701 (generally identified as 270). The first safety block 270 is operatively connected to the bedplate 220. From this engagement, the second rail system 109B is released from the bedplate 220. As a result, the bedplate 220 is configured to move against the second rail system 109B. The first safety block 2701 is normally in a state that engages the first rail 2401 to prevent relative motion between itself and the first rail 2401, thereby preventing movement of the bedplate 220.

The first safety block 2701 is generally rectangular in shape and includes a rail-facing surface 270A that is formed with a wedge shaped center groove 270B, extending from a top edge 270C to a bottom edge 270D of the safety block 270. In operation, the top edge 270C is against a bottom surface of the bedplate 270 and the groove 270B is against the rail so that the rail projects into the block 220. The wedge shaped groove is shaped like a right-triangle with a side surface 270B1 that extends normal to the top and bottom edges 270C, 270D. Within the groove 270B, adjacent the bottom edge 270C, is a cylindrical pivot 270E that extends from a back surface 270F of the block 270 toward the rail-facing surface 270A. The wide end of the groove 270B, at the bottom edge 270C, includes a protrusion or shelf 270G that extends parallel to the bottom edge 270D narrows the groove 270B so that the bottom mouth of the groove 270H, defining an opening in the bottom edge of the block 220, is substantially as narrow as the top mouth 2701, defining an opening in the top edge of the block 220. The cylindrical pivot 270E is located to be partially within a substantially rectangular path defined between the bottom and top mouths 270H, 270I. Due to the weight of the bedplate 220, safety block pivots about the cylindrical pivot 270E to lock the block against the protrusion (e.g., via friction against the rail, or insertion into a rail aperture) so that in its normal state, the bedplate 220 is prevented from moving downwardly. Engaging the block by pivoting around the cylindrical pivot 270E releases the grip between the protrusion 270C of the block and the rail.

In one embodiment, a plurality of safety blocks 2701, 2702, 2703, e.g., first, second and third safety blocks, respectively engage the plurality of rails 2401, 2402, 2403 to prevent movement of the bedplate 220. While reference herein is to a plurality of safety blocks 270, the utilization of a single safety block 2701 is within the scope of the disclosure.

Figure 7:
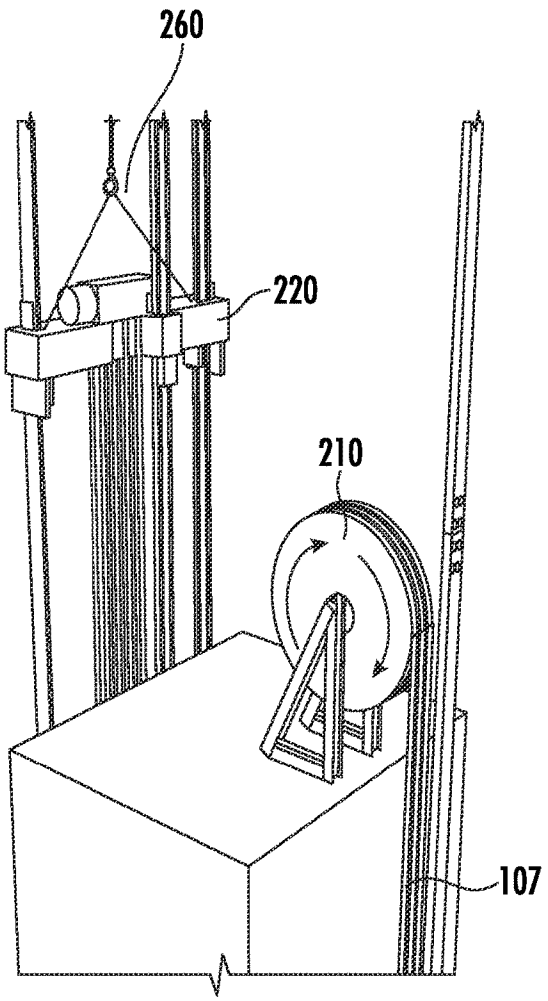
FIG. 7 shows a stage of expansion of the elevator system, where the bedplate is raised.
Figures 8, 9:
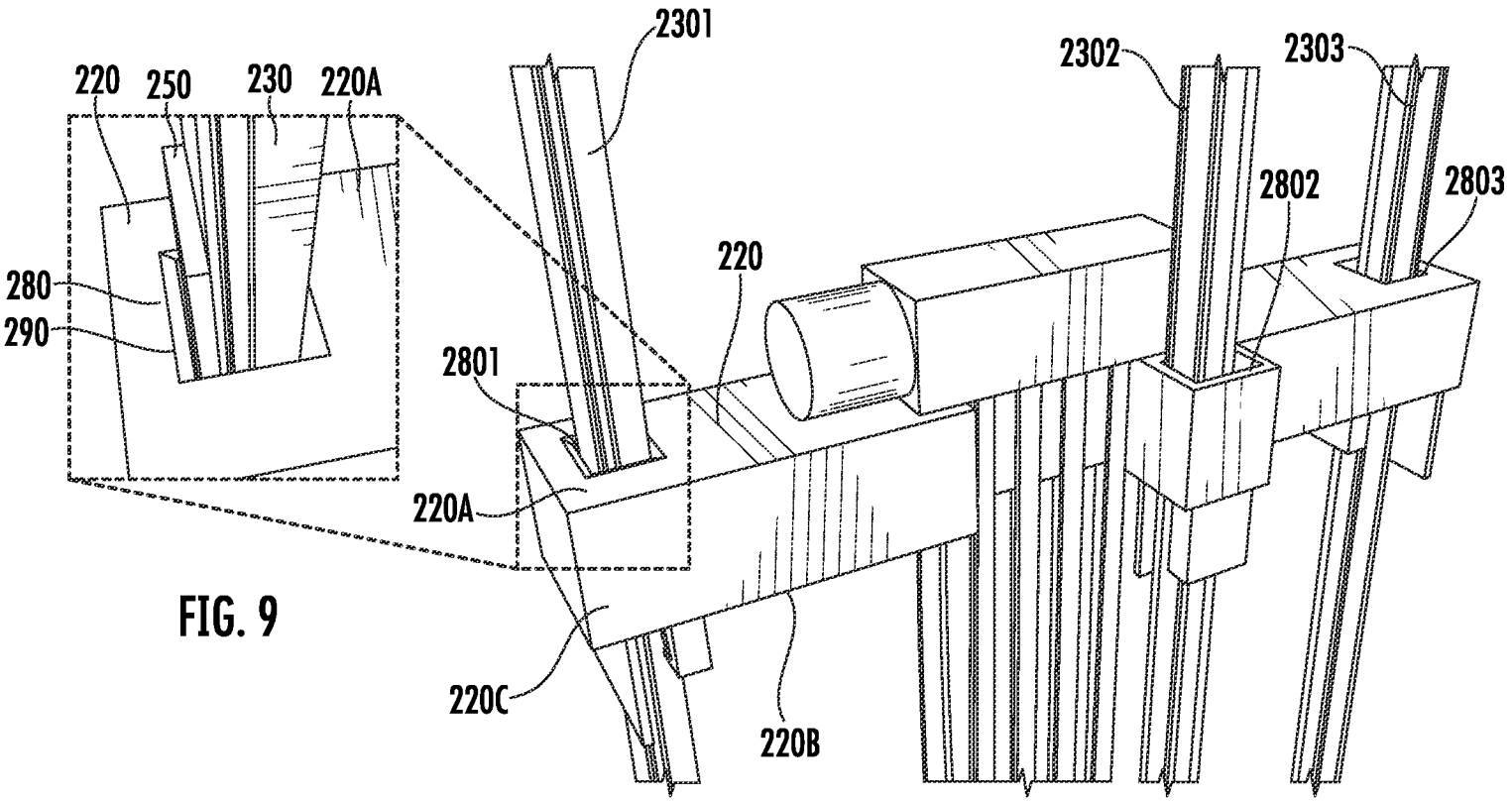
FIG. 8 shows features of a bedplate.
FIG. 9 is a section of the bedplate of FIG. 8.

With reference to FIGS. 7 and 19, as shown in block 140, the method includes raising the bedplate 220 to the second level 125B via the winch 260. As shown in FIGS. 8-9, in one embodiment, the bedplate 220 defines a plurality of pass-through apertures 2801, 2802, 2803, e.g., first, second and third pass-through apertures, generally referenced as 280. The pass-through apertures 280 extend from a top surface 220A of the bedplate 220, through a body 220C of the bedplate 220 and to a bottom surface 220B of the bedplate 220. The pass-through apertures 2801, 2802, 2803 respectively receive the plurality of rails 2401, 2402, 2403 and the respective rail extension members 2301, 2302, 2303. In one embodiment, each of the plurality of pass-through apertures 2801, 2802, 2803, at a top surface of the bedplate 220, defines a top boundary edge, e.g., edge 290, that is chamfered. This configuration guides respective ones the rail brackets 2501, 2502, 2503 into the pass-through apertures 2801, 2802, 2803 when raising the bedplate 220.

Figure 10:
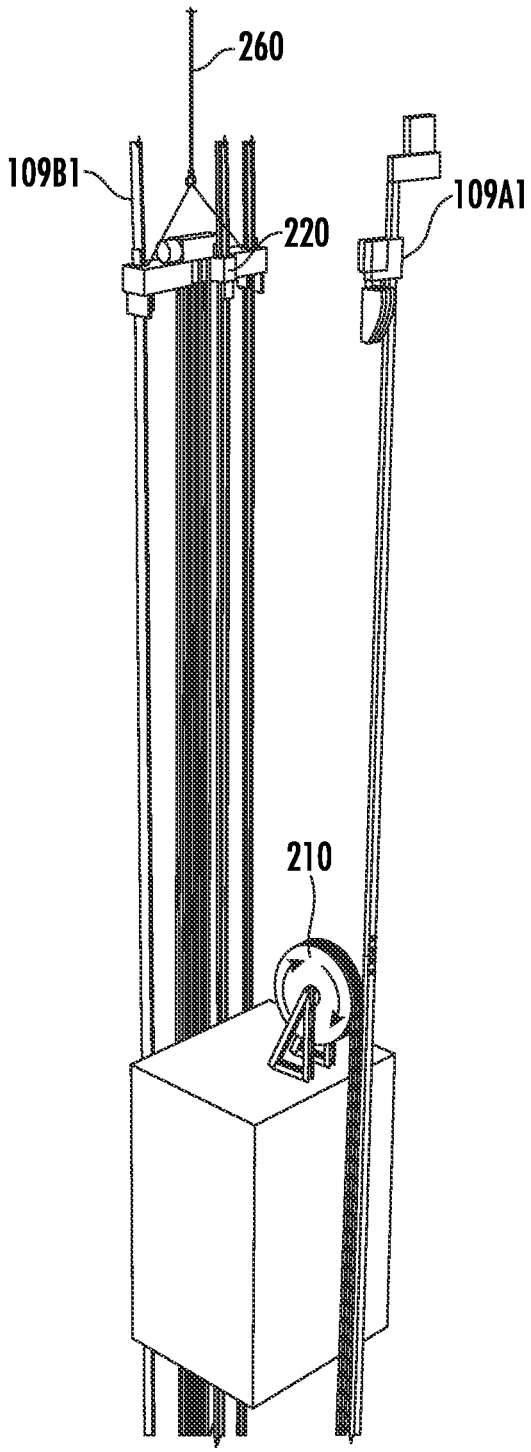
FIG. 10 shows a stage of expansion of the elevator system, where the bedplate is substantially completely raised while connected to the winch.
Figure 11:
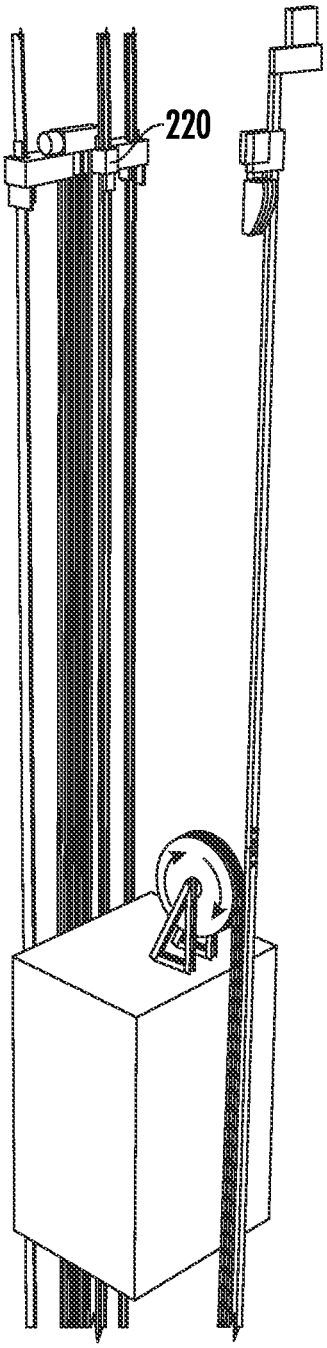
FIG. 11 shows a stage of expansion of the elevator system, where the winch is disconnected from the bedplate.

As shown in FIG. 10, at the raised position, the height of the bedplate 220 is substantially level with, or near, the first top end 109A1 of the first rail system 109A. Raising the bedplate 220 to the second level 125B draws a length of the tension system 107 from the spool 210 that is available due to relocating the spool 210 as indicated. With reference to FIGS. 11 and 19, as shown in block 150, the method includes securing the bedplate 220 at the second level 125B. According to an embodiment, securing the bedplate 220 at the second level 125B is accomplished by engaging the safety blocks 270 to fix the bedplate 220 against the second rail system 109B.

Figure 13:
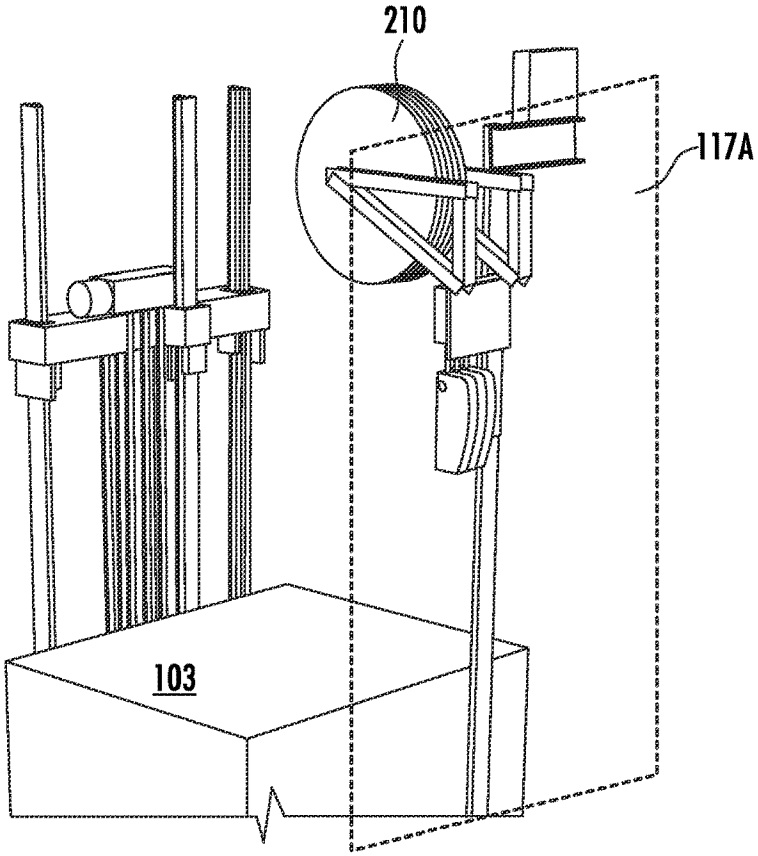
FIG. 13 shows a stage of expansion of the elevator system, where the spool is attached to the hoistway wall.
Figure 12:
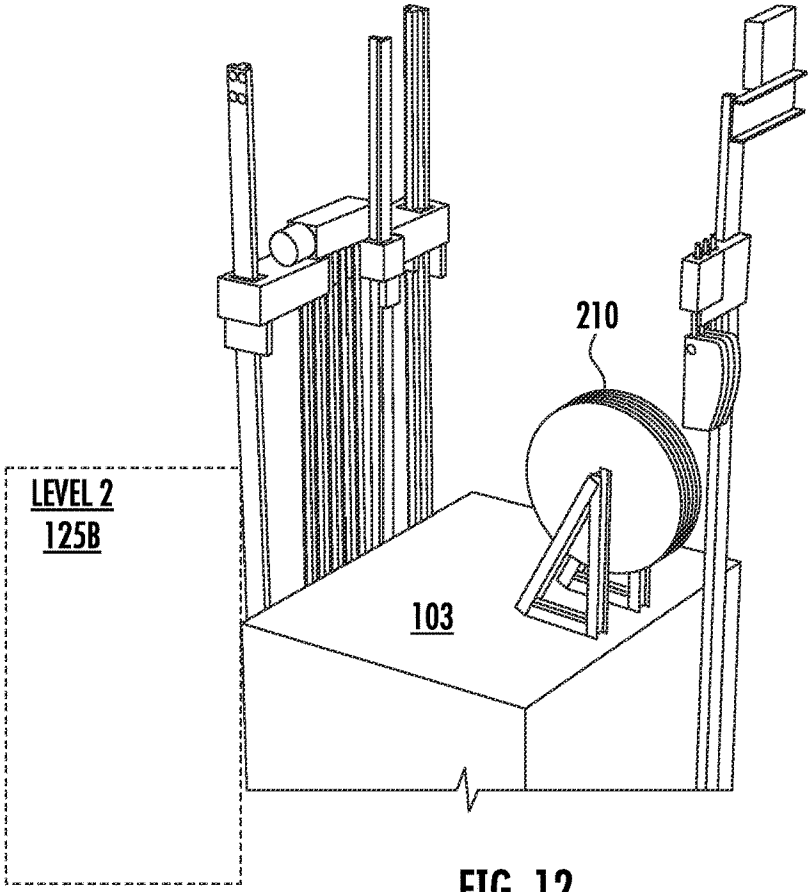
FIG. 12 shows a stage of expansion of the elevator system, where the elevator car is raised to the newly defined level.
Figure 14:
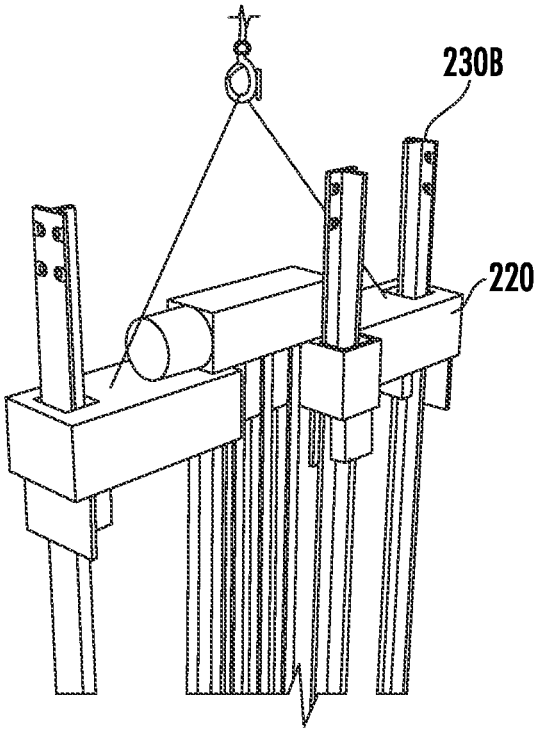
FIG. 14 shows a stage of expansion of the elevator system, in a circumstance where the expansion terminates at a highest level in a building, and where the rail extension members terminate above the bedplate.
Figure 15:
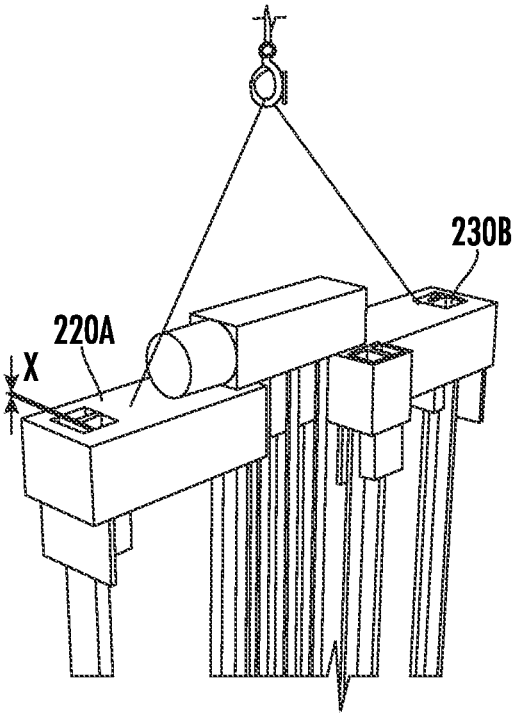
FIG. 15 shows a stage of expansion of the elevator system, where the rail extension members are trimmed back to the bedplate.
Figure 16:
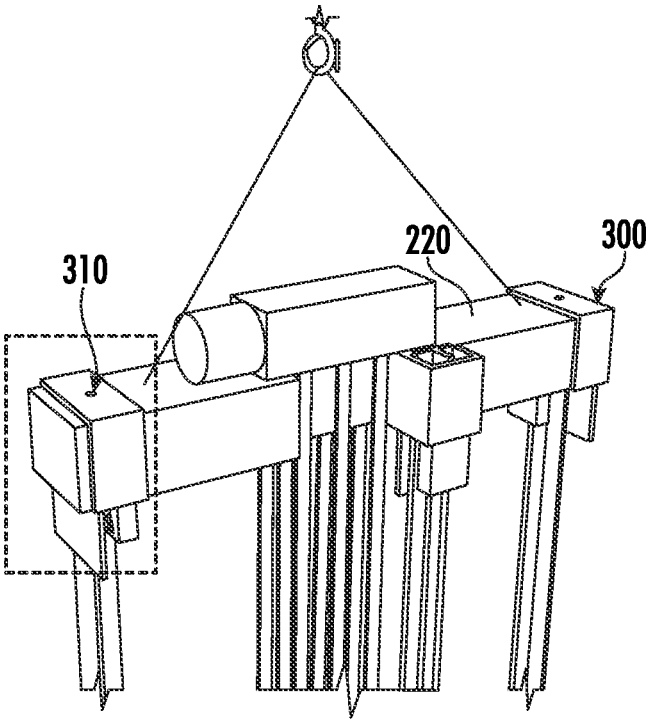
FIG. 16 shows a stage of expansion of the elevator system, where the rail extension members are covered.
Figure 17:
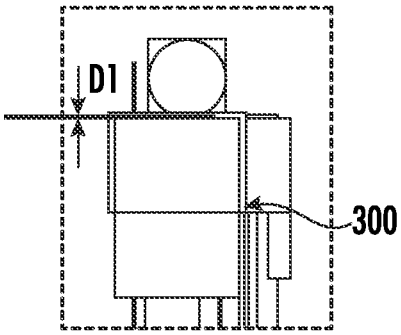
FIG. 17 is a section of the bedplate of FIG. 16.

With reference to FIGS. 11 and 19, as shown in block 160, the method includes releasing the bedplate 220 from the winch 260. With reference to FIGS. 12 and 19, as shown in block 170, the method includes raising the elevator car 103 to the second level 125B and parking the elevator car 103 there. With reference to FIGS. 13 and 19, as shown in block 180, the method includes disconnecting the spool 210 from the elevator car 103 and reconnecting it to the first wall 117A, at the second level 125B. The tension system 107 is lengthened or replaced as needed so that the elevator car 103 can travel between the first and second levels 125A, 125B With reference to FIGS. 14-17, in one embodiment, the jump to the second level 125B as discussed above is a jump to the highest floor in the building 200. At the end of such jump, after securing the safety the bedplate 220 against the second rail system 109B (block 150), and prior to releasing the bedplate from the winch (block 160), the top end 109B1 of the second rail system 109B is trimmed back and capped. Specifically, with further reference to FIGS. 14-15 and 20, as shown in block 190, the method includes trimming a top portion 230B of the rail extension members 230 so that each is level with a top surface 220A of the bedplate 220. With reference to FIGS. 16-17 and 20, as shown in block 200, the method includes attaching a rail cover 300 to the bedplate 220. This covers the top portion 230B of the rail extension members 230. As shown in block 210, a leveling feature 310 may be utilized with the rail cover 300 to level the bedplate 220 against the top portion 230B of one or more of the rail extension members 230. For example, a screw may engage a top portion 230B of the first rail extension member 230 to raise one side of bedplate 220 by a first distance D1 relative to the other side so that the bedplate 220 is level.

Figure 18:
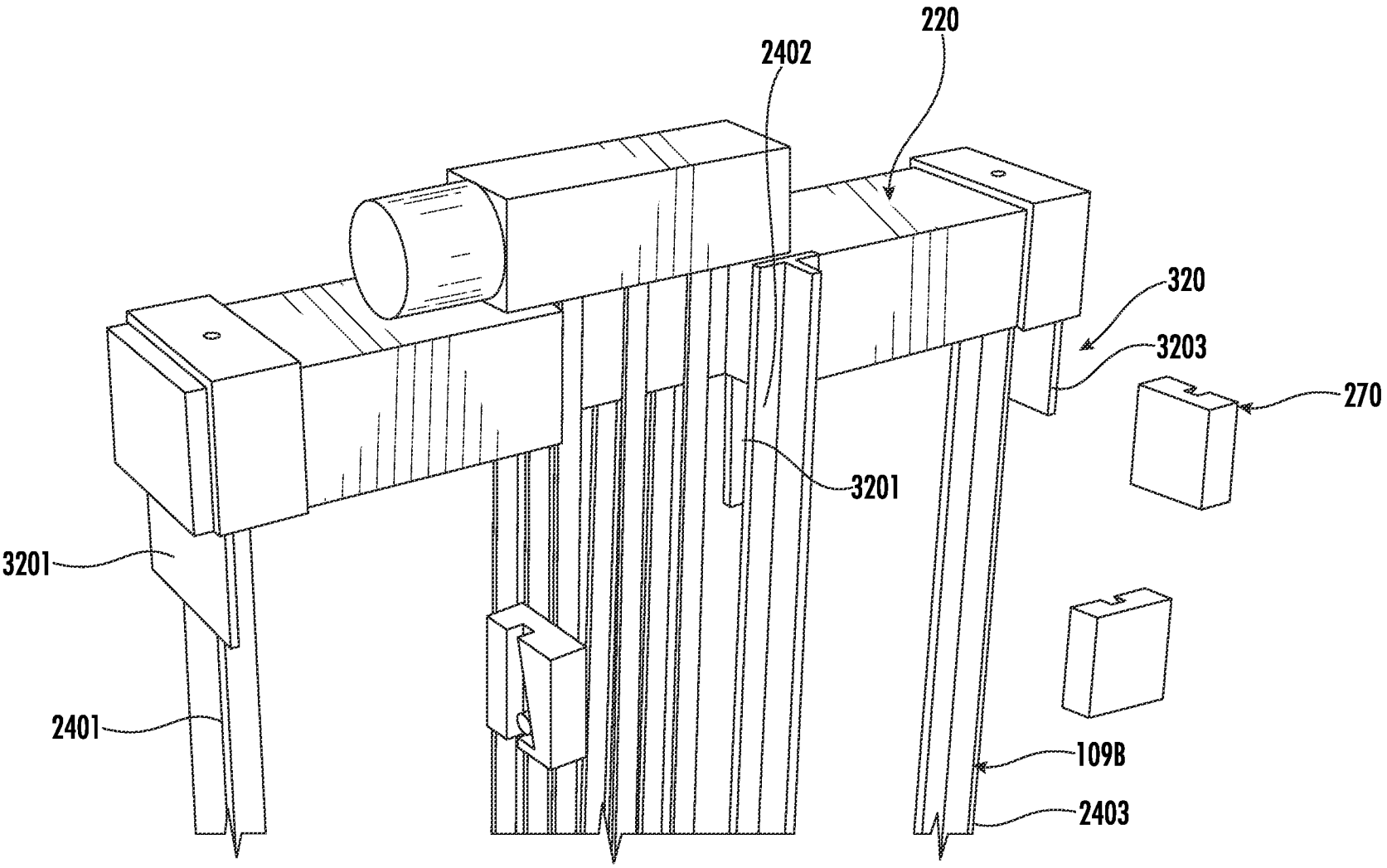
FIG. 18 shows a stage of expansion of the elevator system, where safety blocks are removed.

As shown in FIGS. 18 and 20, and as shown in block 210, securing the bedplate 220 at the second level 125B (block 150) further includes engaging a first fixation clip 3201 (generally identified as 320), operatively connected to the bedplate 220, against the second rail system 109B. As shown in block 220, the method includes removing the safety blocks 270 from the bedplate 220. In one embodiment, a plurality of fixation clips 3201, 3202, 3203, e.g., first, second and third fixation clips, are operatively connected to the bedplate 220 and respectively engage the first, second and third rails 2401, 2402, 2403 to secure the bedplate 220 to the second rail system 109B at the second level 125B. While reference herein is to a plurality of fixation clips 320, the utilization of a single fixation clip 3201 is within the scope of the disclosure.

Turning to FIG. 21, in an alternate embodiment, the disclosed method may be accomplished with a subset of steps identified above. In such embodiment, the method includes block 100 of parking the elevator car 103 at or below the first level 125A of the building 200. As shown in block 110, the method includes raising the second rail system 109B to the second level 125B. As shown in block 1201, the method includes supporting the elevator machine 111 with the bedplate 220. As shown in block 130, the method includes engaging the first safety block 2701 (or safety blocks 270) to release the bedplate 220. As shown in block 1401, the method includes raising the bedplate 220 to the second level 125B.

The above configuration enables positioning of the bedplate 220 at any location along the rails with the use of the safety blocks 270. This enables a more efficient expansion of an elevator system in a hoistway.

For electronic implements identified above, embodiments can be in the form of processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method of expanding an elevator system in a hoistway of a building, comprising:

parking an elevator car at or below a first level, between a first rail system extending along first wall of the hoistway and a second rail system extending along a second wall of the hoistway that is opposite the first wall, wherein the first rail system extends to a first top end located at second level that is above the first level, and the second rail system extends to a second top end that is below the second level;

raising the second rail system to the second level;

supporting an elevator machine with a bedplate, wherein the elevator machine is operatively connected to a machine end of a tension system and the tension system is operationally connected to the elevator car;

engaging a first safety block, operatively connected to the bedplate, to release the second rail system, whereby the bedplate is configured to move against the second rail system; and raising the bedplate to the second level, wherein:

prior to raising the second rail system to the second level, the method includes:

disconnecting a spool, operatively connected a spool end of the tension system, from the first wall, and connecting the spool to a ceiling of the elevator car, wherein raising the bedplate to the second level while the spool is connected to the ceiling of the elevator car draws an additional length of the tension system from the spool.

2. The method of claim 1, further comprising:

raising the elevator car to the second level and parking the elevator car at the second level;

disconnecting the spool from the elevator car, and reconnecting the spool to the first wall.

3. The method of claim 2, wherein:

securing the bedplate to the second level includes:

engaging the first safety block to fix the bedplate against the second rail system.

4. The method of claim 3, wherein:

raising the second rail system to the second level includes:

connecting a bottom end of a first rail extension member to a top end of a first rail of the second rail system.

5. The method of claim 4, wherein:

the bottom end of the first rail extension member is connected to the top end of the first rail of the second rail system via a first rail bracket.

6. The method of claim 5, wherein:

after raising the bedplate to the second level, the method includes:

trimming a top portion of the first rail extension member so that it is level with a top of the bedplate; and attaching a rail cover to the bedplate, to thereby cover the top end of the first rail.

7. The method of claim 6, comprising:

utilizing a leveling feature to level the bedplate against the top end of the first rail.

8. The method of claim 7, wherein:

after attaching the rail cover to the bedplate, the method includes:

engaging a first fixation clip, operatively connected to the bedplate, against the second rail system; and removing the first safety block from the bedplate.

9. The method of claim 6, wherein:

the second rail system includes a plurality of rails, including the first rail, the plurality of rails are respectively extended via a plurality of rail extension members, including the first rail extension member, that are respectively connected to one another via a plurality of rail brackets, including the first rail bracket; and the bedplate defines a plurality of pass-through apertures for respectively receiving the plurality of rails.

10. The method of claim 9, wherein:

each of the plurality of pass-through apertures, at a top surface of the bedplate, defines a top boundary edge that is chamfered to guide respective ones the plurality of rail brackets into the plurality of pass-through apertures.

11. The method of claim 2, wherein:

prior to raising the elevator car to the second level, the method includes raising the bedplate to the second level via a winch, securing the bedplate to the second level, and disconnecting the winch.

* * * * *